US006247748B1

(12) United States Patent
Zheng

(10) Patent No.: US 6,247,748 B1
(45) Date of Patent: Jun. 19, 2001

(54) SEAT SUPPORT ARRANGEMENT FOR FOLDING CHAIR

(76) Inventor: Edward Zheng, 1736 Wright Ave., La Verne, CA (US) 91750

( * ) Notice: Subject to any disclaimer, the term of this patent is extended or adjusted under 35 U.S.C. 154(b) by 0 days.

(21) Appl. No.: 09/477,025

(22) Filed: Jan. 3, 2000

(51) Int. Cl.[7] ..... A47C 4/42
(52) U.S. Cl. ..... 297/16.2; 297/440.11
(58) Field of Search ..... 297/16.2, 16.1, 297/45, 54, 440.11

(56) References Cited

U.S. PATENT DOCUMENTS

| | | | | |
|---|---|---|---|---|
| 2,694,438 | * | 11/1954 | Frech | 297/440.11 X |
| 3,222,108 | * | 12/1965 | Pablos | 297/440.11 |
| 3,437,375 | * | 4/1969 | Kettler | 297/440.11 |
| 4,047,752 | * | 9/1977 | Rohr | 297/440.11 X |
| 4,671,566 | * | 6/1987 | Knapp et al. | 297/16.2 |
| 5,984,406 | * | 11/1999 | Lee | 297/458 |

FOREIGN PATENT DOCUMENTS

| | | | | |
|---|---|---|---|---|
| 1417366 | * | 10/1965 | (FR) | 297/440.11 |

* cited by examiner

*Primary Examiner*—Peter R. Brown
(74) *Attorney, Agent, or Firm*—Raymond Y. Chan; David and Raymond Patent Group

(57) ABSTRACT

The present invention provides a seat support arrangement for a folding chair including a foldable chair frame supporting a fabric seat having a back support portion and a seat support portion, wherein the seat support arrangement comprises a thigh supporting flap integrally and frontwardly extended from a front end of the seat support portion of the fabric seat, and a pair of seat supporting arms which are frontwardly extended from two front upper frame joints of the foldable chair frame and parallelly connected to two side edges of the thigh supporting flap so as to better and more evenly support the seat support portion in such a manner that the thigh supporting flap of the fabric seat is firmly supported to extend frontwardly so as to substantially increase a sitting area of the seat support portion of the fabric seat without increasing the folding size of the folding chair.

34 Claims, 9 Drawing Sheets

SEAT SUPPORT ARRANGEMENT FOR FOLDING CHAIR

BACKGROUND OF THE PRESENT INVENTION

1. Field of Invention

The present invention relates to fabric made portable seat products, and more particularly to a seat support arrangement for folding chair which can evenly distribute a downward pulling force on the fabric seat and minimize a stress around the supporting ring.

2. Description of Related Arts

Referring to FIG. 1 of the drawing, a conventional portable chair comprises a foldable chair frame constructed by metal tubes and a chair seat made of durable fabric wherein the foldable chair frame A1 is constructed by a pair of back legs A11 to provide a back frame A2 and a seat frame A3 for supporting a fabric seat B1. The back frame A2 and the seat frame A3 are arranged in such a manner that the chair frame A1 can be easily opened to provide a rigid cross-support for use and be folded up for storage.

The conventional method of attaching the fabric seat B1 to the chair frame A1 is to affix an upper end B2 of the fabric seat B1 to a top end of the back frame section A2 and to have two leg placement holes B11 reinforced by two lining pads B12 at two front comers of the fabric seat B1 for mounting a front end B3 of the fabric seat B1 on the seat frame A3. The conventional fabric seat B1 is attached to the seat frame A3 by slipping the placement holes B11 over the frame extension legs of the seat frame portion of the chair. The seat can then be hooked over the top of the back frame A2 to secure the back of the fabric seat B1 to the frame. This means that at least two leg placement holes B11 on the front portion of the fabric seat B1 are needed for attaching the conventional fabric seat B1 to the front portion of the seat frame A3.

All typical frame legs, including two front frame legs A11*a*, are cylindrical hollow leg and the two leg placement holes B11 of the conventional fabric seat B1 are circular holes reinforced with two lining pads B12 which are affixed on top of two front frame joints A12 by means of a pair of affixing plugs B13.

However, these conventional structures of mounting the front end B3 of the fabric seat B1 to the frame joints A12 of the chair frame A1 have inherent problems when the chair is used. Since the two front frame legs A11*a* are supported inclinedly and pivotally in cross manner but not in vertical manner, an individual sitting down on the fabric seat B1 causes stress to the lining pads B12 of the leg placement holes B11 of the fabric seat B1. This causes the leg placement hole B11 to be stretched and misshapen, or worse, torn open, as a pulling pressure is applied to the lining of the leg placement holes B11 as in individual sits on the fabric seat B1.

When an individual sits down, an angle is created on the fabric seat B1 from the downward pulling force on the fabric seat B1 at the point where the edge of the support ring is pulled from a stress created at the edge of the support ring ends. An individual's weight causes the fabric seat B1 to be pulled away from the edges of the two placement holes B11. Therefore, the fabric seat B1 at the edges of the leg placement holes B11 are pulled from a stress created at the edges of the leg placement holes B11. At the same time, each of the lining pads B12 itself causes an opposite downward pulling force on the fabric seat B1 at the same stress point. As a result, the fabric seat B1 will be distorted at the edge of the leg placement hole B1, creating a pointed ridge at the edge of the leg placement hole B11.

In other words, the stress on the fabric seat B1 has simply been transferred from the lining pads B12 of the leg placement holes B11 to a point just off each of the leg placement holes B11. The stress created will then cause a tear, not at the leg placement hole B11, but along the edge of the leg placement hole B11. Also, the fabric will be permanently misshapen at the stress point over a period of continued use.

Besides, in order to reduce the folding size of the of the chair frame A1 of the folding chair for easy storage and carrying, the two front frame legs A11*a* are made as closed to the back legs A11 as possible. However, the sitting area of the fabric seat B1 which substantially supports the weight of the user is limited too. Normally, such a limited sitting area of the fabric seat can merely support the buttock portion and an upper portion of the thigh of the user. Therefore, most of the users of the conventional folding chair have an intention to slide out of the seat frontwardly.

SUMMARY OF THE PRESENT INVENTION

A main object of the present invention is to provide a seat support arrangement for folding chair which substantially increases the supporting area of the fabric seat to more evenly distribute and support the downward pulling force and stress applied by the user's weight.

Another object of the present invention is to provide a seat support arrangement for folding chair, wherein a thigh supporting flap of the fabric seat is supported by two seat supporting arms frontwardly extended from two front upper frame joints in such a manner that no hole is needed to provided on the front end of the fabric seat and an individual is allowed to sit on the fabric seat without distorting the shape of the fabric seat.

Another object of the present invention is to provide a seat support arrangement for folding chair, wherein the attachment of the front end of the fabric seat with the foldable chair frame is easy and fast, that is simply by inserting the two seat supporting arms into to two side pockets provided on two sides of the thigh supporting flap of the fabric seat.

Another object of the present invention is to provide a seat support arrangement for folding chair, wherein the lower portion of the user's thigh can also be well supported without increasing the distance between the front frame legs and the back legs, i.e. the folding size of the chair frame. In other words, the chair frame of the present invention is more comfortable and capable of supporting more weight in comparison with the conventional chair frame having same frame structure and size.

Accordingly, in order to accomplish the above objects, the present invention provides a seat support arrangement for a folding chair which comprises:

- a foldable chair frame supporting a fabric seat having a back support portion and a seat support portion, wherein the seat support arrangement comprises:
  - a thigh-supporting flap integrally and frontwardly extended from a front end of the seat support portion of the fabric seat,
  - and a pair of seat supporting arms which are frontwardly extended from two front upper frame joints of the foldable chair frame and parallelly connected to two side edges of the thigh supporting flap so as to evenly support the seat support portion in such a manner that the thigh supporting flap of the fabric seat is firmly supported to extend frontwardly so as to substantially increase a seat area of the seat support portion of the fabric seat.

DETAILED DESCRIPTION OF THE PREFERRED EMBODIMENT

Figure 2:
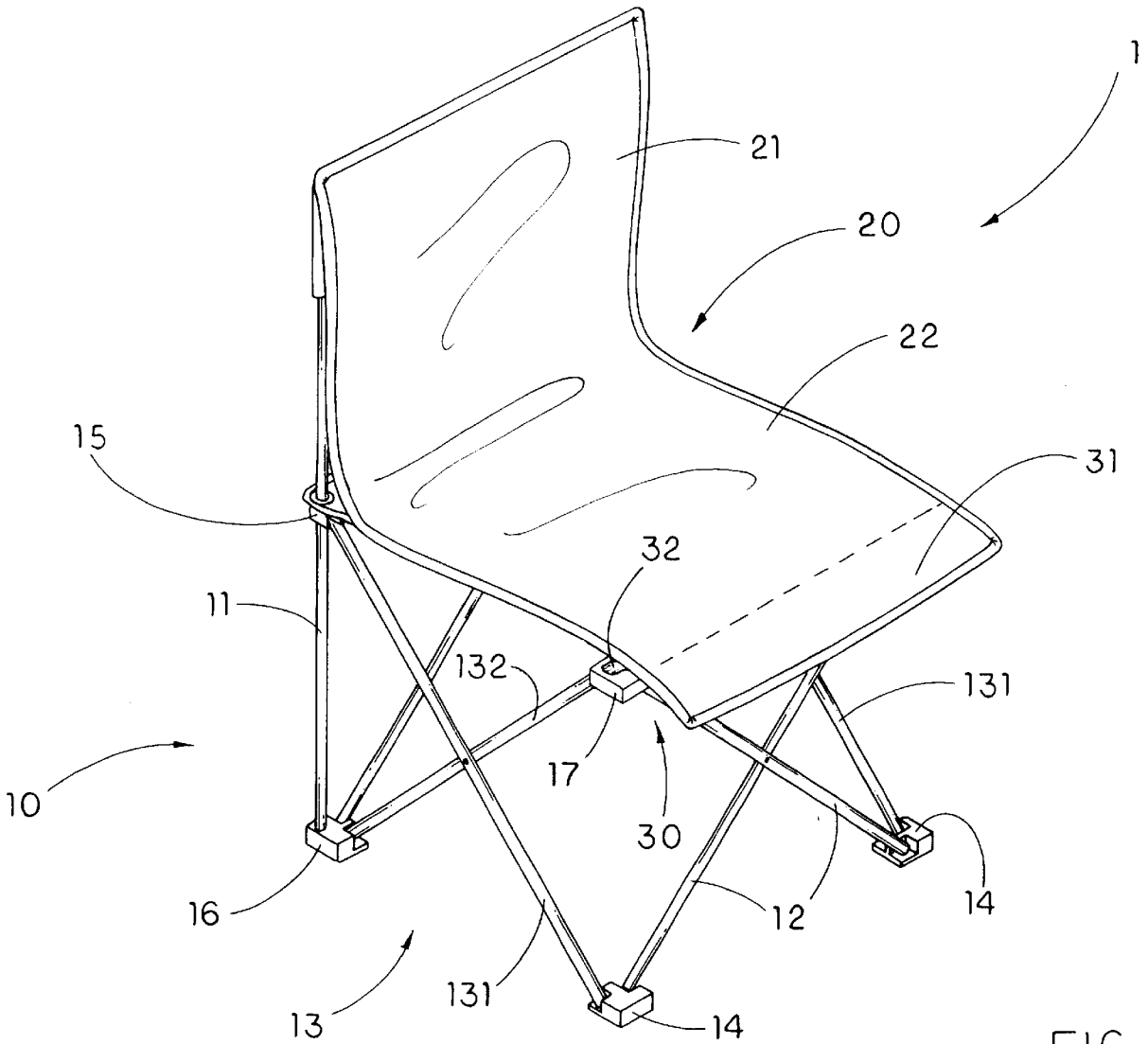
FIG. 2 is a perspective view of a folding chair employed with a seat support arrangement according to a preferred embodiment of the present invention.

Referring to FIG. 2, a folding chair 1 which comprises a foldable chair frame 10 and a fabric seat 20 employed with a seat support arrangement 30 according to a preferred embodiment of the present invention is illustrated.

Figure 5:
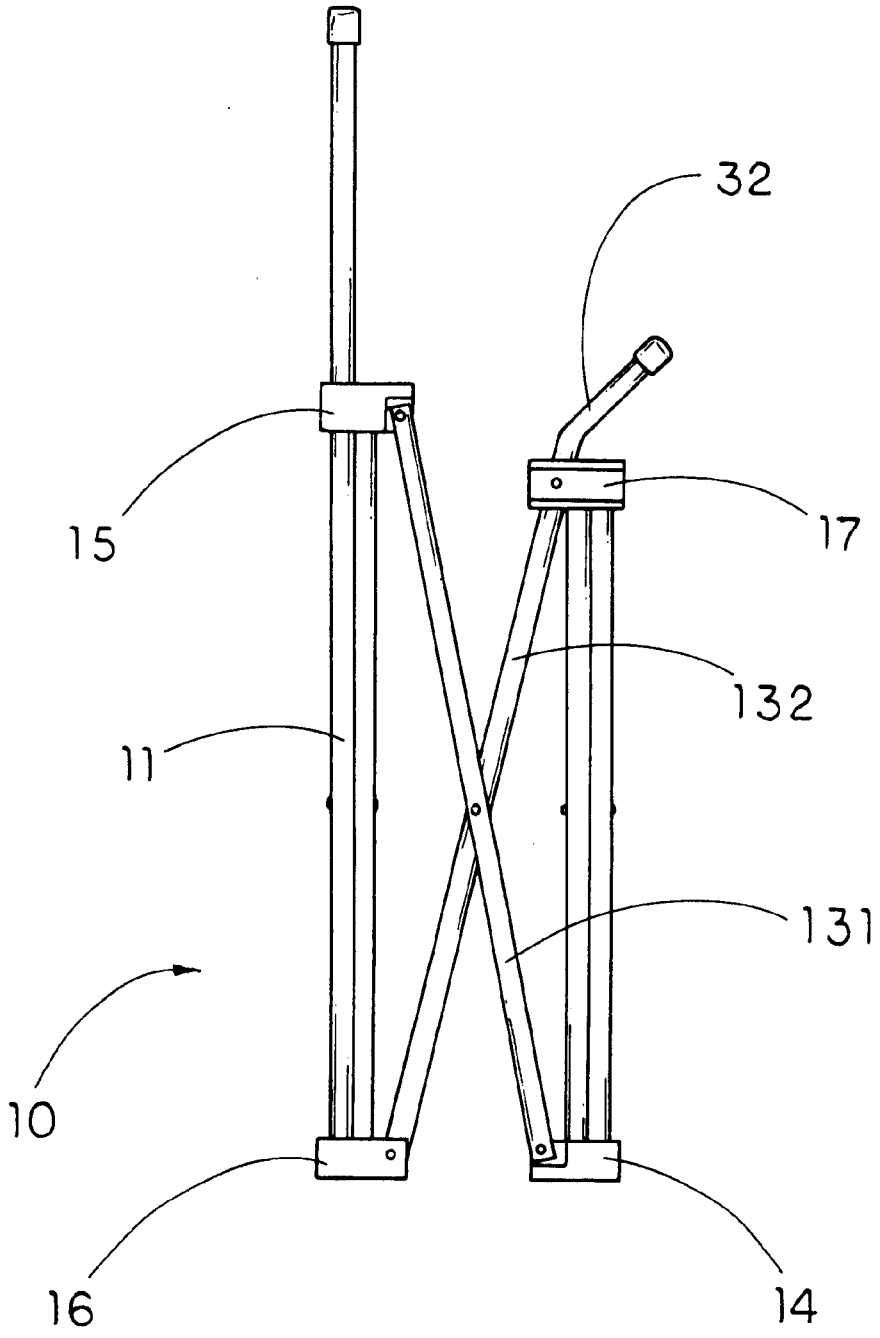
FIG. 5 is a side view of the folded chair frame according to the above preferred embodiment of the present invention.

As shown in FIGS. 2 and 5, the foldable chair frame 10 are made of metal tubes, comprising a pair of back frame legs 11, a pair of front frame legs 12 pivotally connected in cross manner, and two pairs of side frame legs 13, wherein each pair includes a first side frame leg 131 and a second side frame leg 132 pivotally connected in cross manner.

The bottom ends of the two first side frame legs 131 are pivotally connected to a pair of front bottom frame joints 14 respectively while the upper ends of the two first side frame legs 131 are extended backwardly and upwardly to respectively pivotally connected to a pair of back upper frame joints 15 that are slidably mounted on the two back frame legs 11. The bottom ends of the two second side frame legs 132 are pivotally connected to a pair of back bottom frame joints 16 respectively while the upper ends of the two second side frame legs 132 are pivotally connected to a pair of front upper frame joints 17 respectively.

As shown in FIG. 2, the fabric seat 20, which is supported by the foldable chair frame 10, has a back support portion 21 upwardly extended to connect with the top ends of the pair of back frame legs 11 and a seat support portion 22 frontwardly extended towards the pair front upper frame joints 17.

Figure 3:
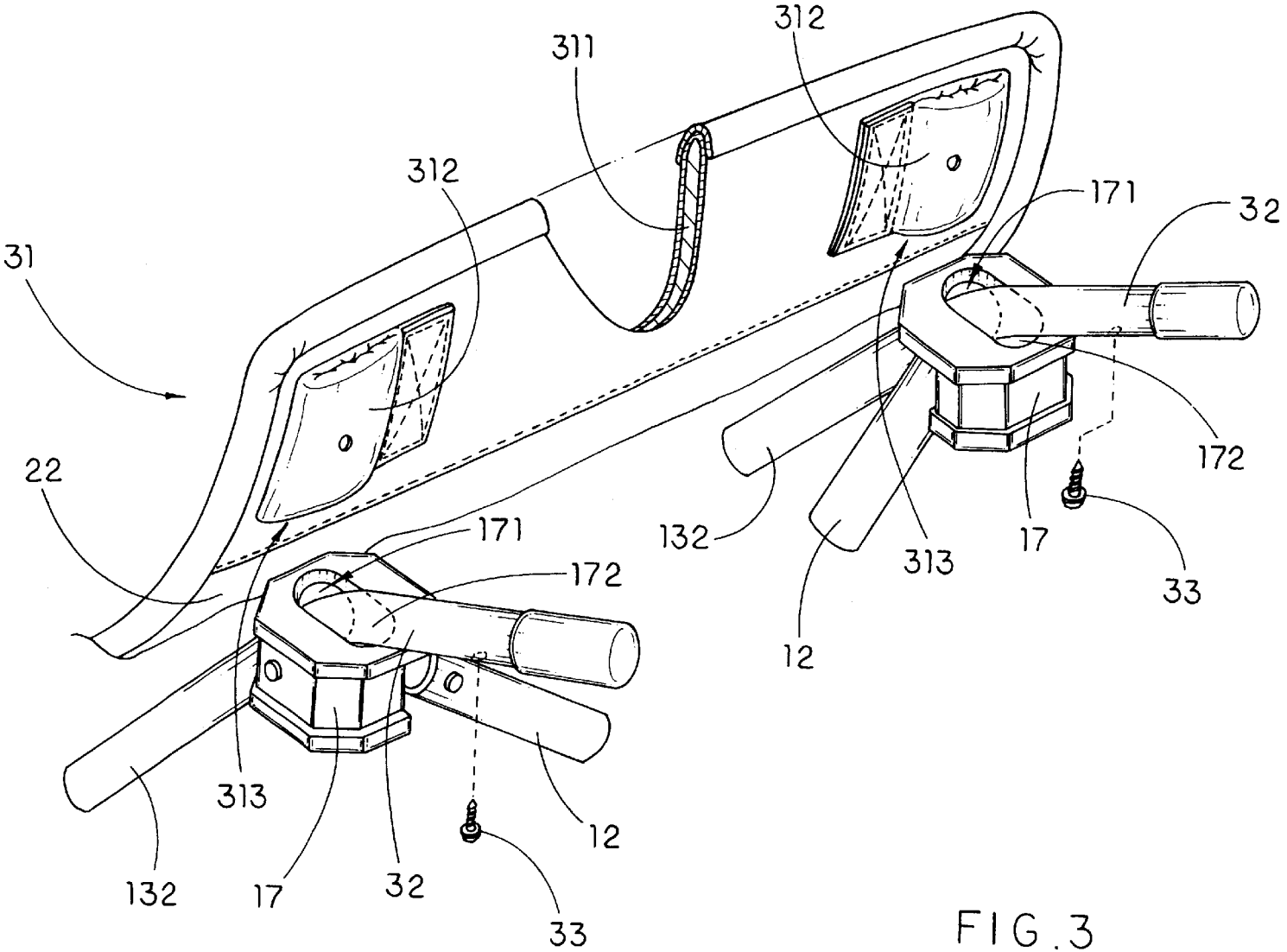
FIG. 3 is a partially exploded perspective view of the seat support arrangement for folding chair according to the above preferred embodiment of the present invention.
Figure 4:
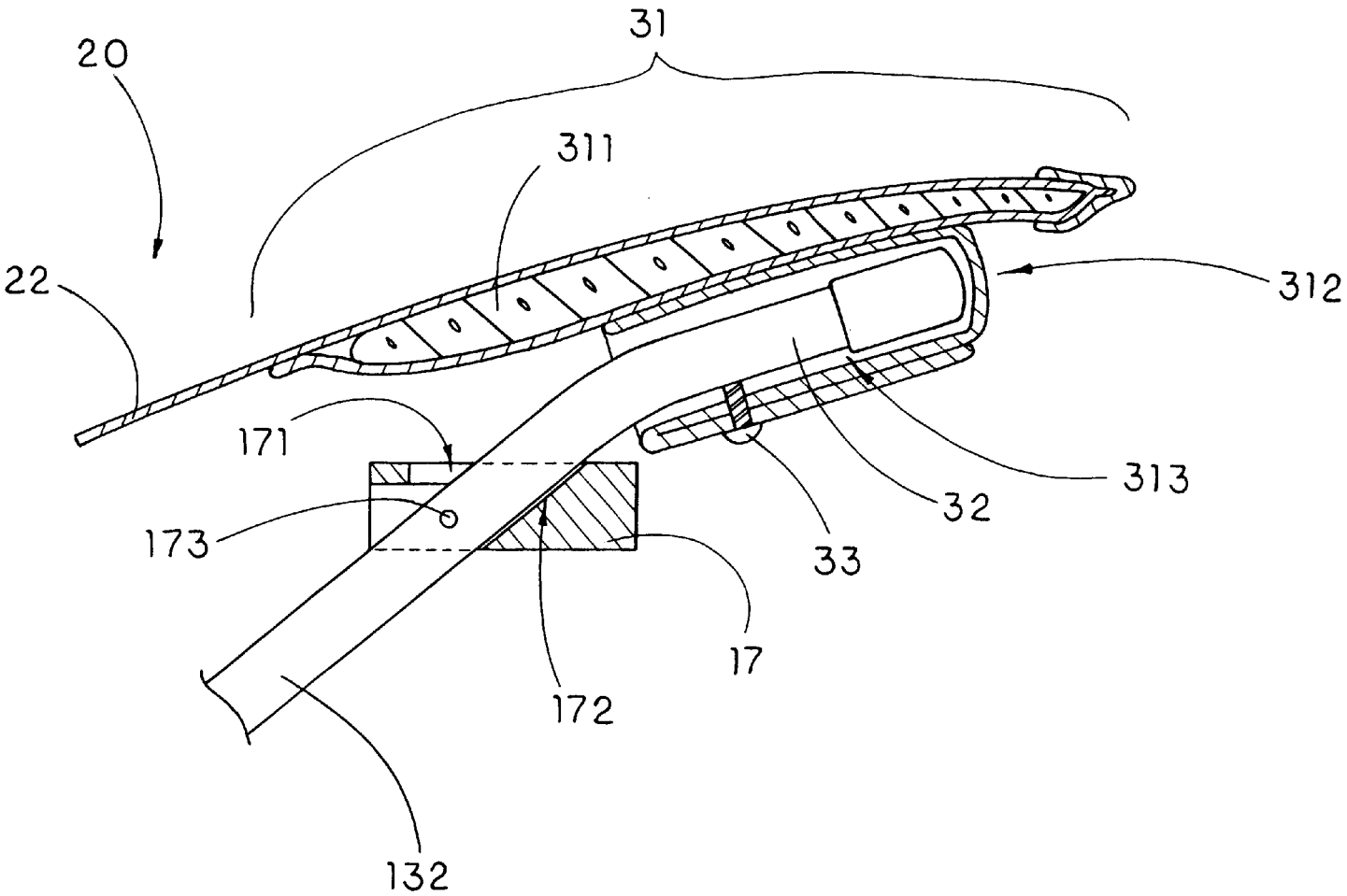
FIG. 4 is a side view of the seat support arrangement for folding chair according to the above preferred embodiment of the present invention.

As shown in FIGS. 3 and 4, the seat support arrangement 30 of the folding chair 1 comprises a thigh supporting flap 31 and a pair of seat supporting arms 32. According to the preferred embodiment as shown in FIG. 2, the thigh supporting flap 31 is an additional fabric extensions integrally and frontwardly extended from a front end of the seat support portion 22 of the fabric seat 20.

As shown in FIG. 3, the thigh supporting flap 31, which has a width larger than a length of the seat supporting arm 32, is preferred to enclose a rubber or foaming made cushion pad 311 to softly and comfortably support the user's thighs rested thereon.

The pair of seat supporting arms 32 are frontwardly extended from the two front upper frame joints 17 of the foldable chair frame 10 and parallelly connected to two side edges of the thigh supporting flap 31 so as to evenly support the seat support portion 22 in such a manner that the thigh supporting flap 31 of the fabric seat 20 is firmly supported to extend frontwardly so as to substantially increase the seat area of the seat support portion 22 of the fabric seat 20.

According to the preferred embodiment as shown in FIGS. 3 to 5, the two seat supporting arms 32 are two upper end portions of the two second side frame legs 132 respectively. Each of the two side frame legs 132 has a length longer than a distance between the respective front upper frame joint 17 and the respective back bottom frame joint 16, so that the two seat supporting arms 32, i.e. the two upper end portions of the two second side frame legs 132, extend through the two front upper frame joints 17 respectively and bend downwardly. Therefore, as shown in FIG. 4, when the foldable chair frame 10 is unfolded to form the folding chair 1 as shown in FIG. 2, each of the two seat supporting arms 32 are bent to frontwardly extend and position horizontally.

In order to well support the two second side frame legs 132 and construct the foldable chair frame 10, the two front upper frame joints 17 are specifically constructed to each have a through hole type support slot 171 for the upper ends of the two second side frame legs 132 to penetrate therethrough upwardly and frontwardly to form the two seat supporting arms 32 respectively, as shown in FIGS. 3 and 4. Moreover, an inclined resting surface 172 is provided within the support slot 171 so that when the respective second side frame leg 132 is pivotally connected to the front upper frame joint 17 with a rivet 173, as shown in FIG. 4, the inclined resting surface 172 can substantially and fittingly support the inclined second side frame leg 132.

When the foldable chair frame 10 is unfolded and stretch out to form the folding chair 1 as shown in FIG. 2, the inclined resting surface 172 and the frontwardly extended seat supporting arms 32 will block and lock up the stretching height of the front upper frame joints 17. In other words, as shown in FIG. 4, the frontwardly extended seat supporting arms 32 provide a more rigid support to the user who sits on the seat support portion 22.

Basically, the two seat supporting arms 32 can be tightened or fastened to the thigh supporting flap 31. However, according to the preferred embodiment as shown in FIGS. 3 and 4, two side pockets 312 are provided at two side edges of a bottom surface of the thigh supporting flap 31 respectively. Each of the side pockets 312 has a front close end and a rear open end to define a tubular pocket cavity 313 therein. Each of the pocket cavities 313 has a depth shorter than the seat supporting arm 32 to fittingly receive the seat supporting arm 32. In order to further firmly hold the seat support portion 22 and the thigh supporting flap 31 to the two seat supporting arms 32, two screws 33 are used to fasten the two side pockets 312 to the two seat supporting arms 32 respectively.

Therefore, as shown in FIG. 2, the seat support arrangement 30 for the folding chair 1 of the present invention can substantially increase the supporting area of the fabric seat 20 to more evenly distribute and support the downward pulling force and stress applied by the user's weight, wherein the thigh supporting flap 31 of the fabric seat 20 is supported by two seat supporting arms 32 frontwardly extended from two front upper frame joints 17 in such a manner that no hole is needed to provided on the front end of the fabric seat 20 and an individual is allowed to sit on the fabric seat without distorting the shape of the fabric seat 20.

Besides, the attachment of the seat support portion 22 of the fabric seat 20 with the foldable chair frame 10 is easy and fast, that is simply by inserting the two seat supporting arms 32 into to two side pockets 312 provided on two sides of the thigh supporting flap 31 of the fabric seat 20.

Moreover, the lower portion of the user's thigh can also be well supported without increasing the distance between the front frame legs 12 and the back frame legs 11, i.e. the folding size of the foldable chair frame 10, as shown in FIGS. 2 and 5. In other words, the foldable chair frame 10 of the present invention is more comfortable and capable of supporting more weight in comparison with the conventional chair frame having same frame structure and size.

Figure 6:
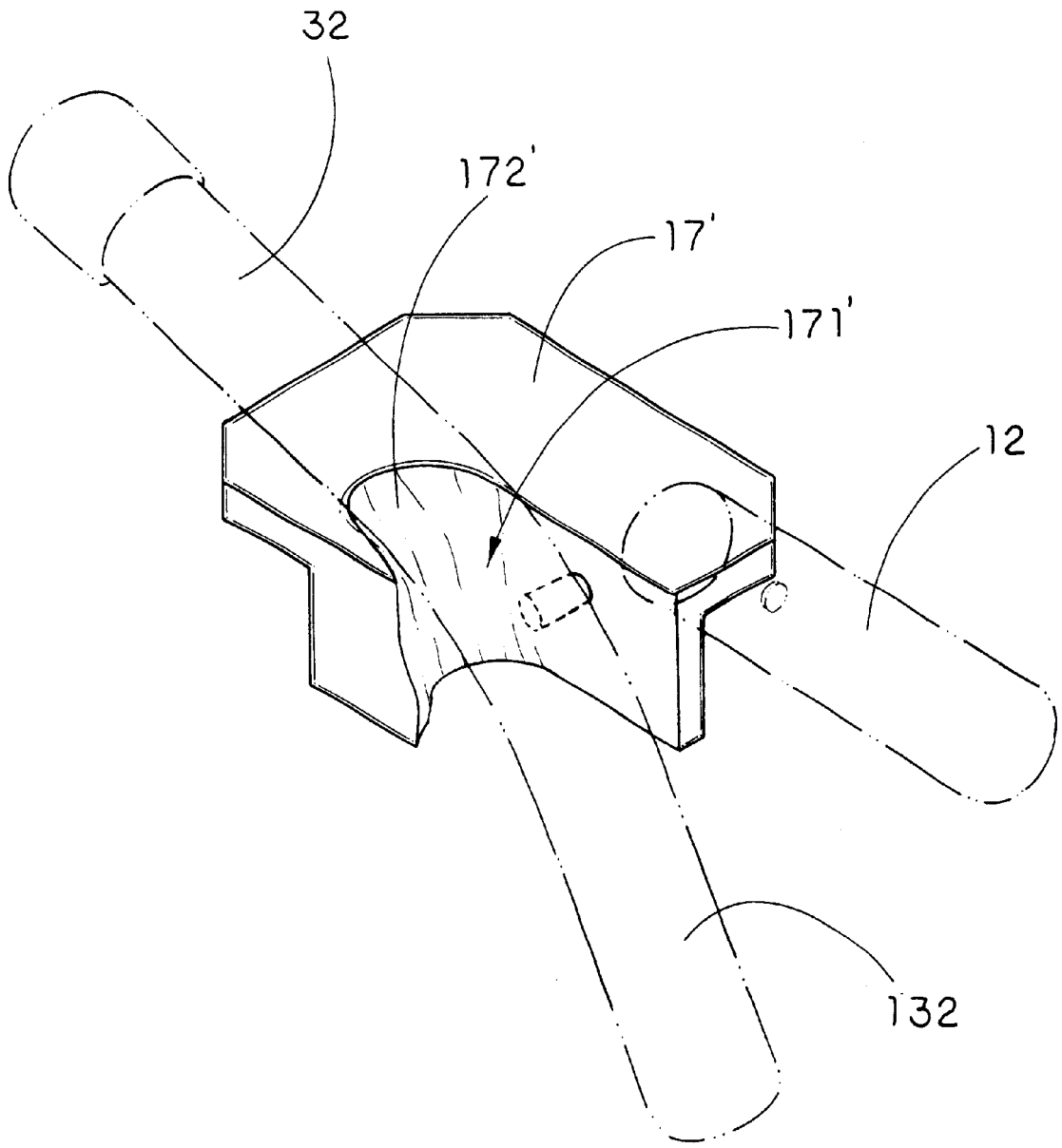
FIG. 6 is an alternative mode of the front upper frame joint according to the above preferred embodiment of the present invention.

FIG. 6 illustrates an alternative mode of the front upper frame joint 17', wherein the through hole type support slot 171 as shown in FIG. 3 is modified to a side groove type support slot 171' that also provides an inclined resting surface 172' to support the inclined second side frame leg 132 which is pivotally connected to a side wall of the support slot 171'.

Figure 7:
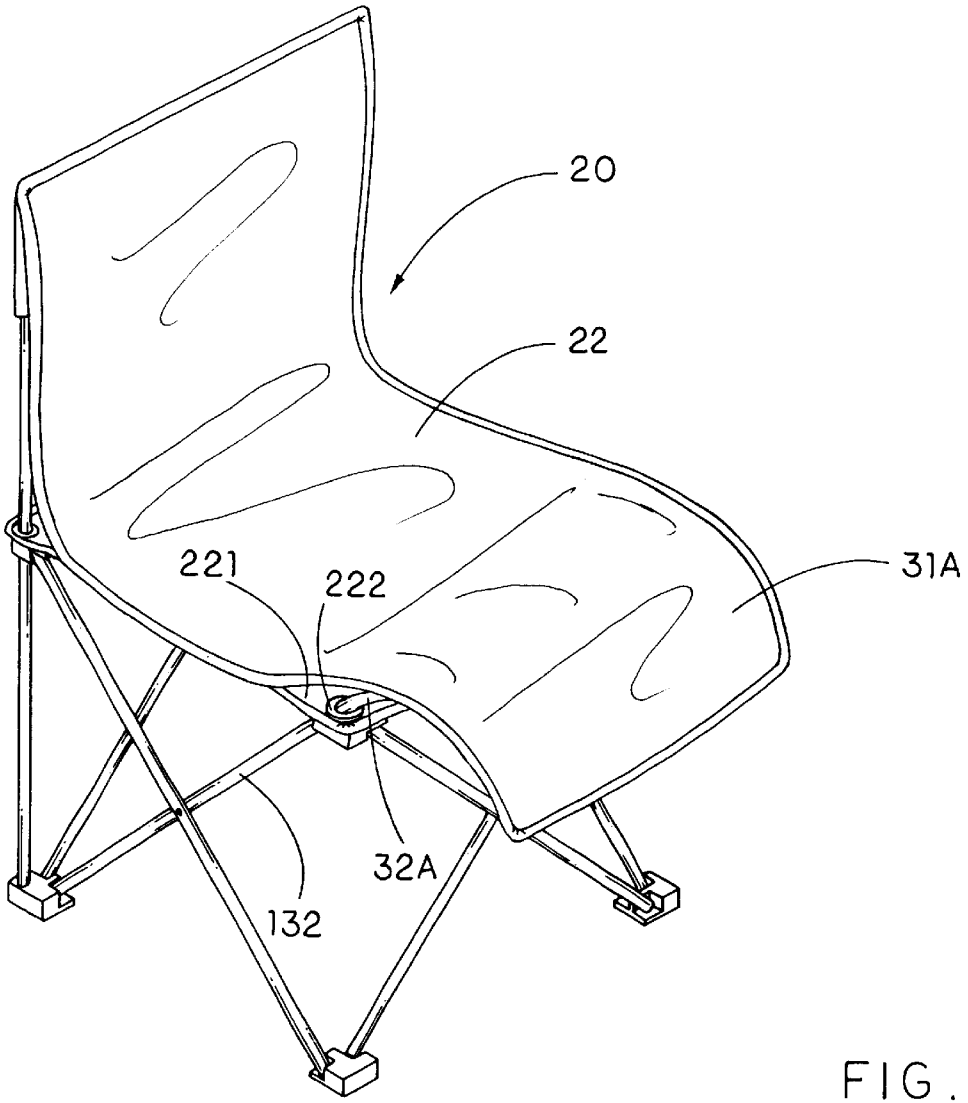
FIG. 7 is a perspective view of a folding chair employed with a seat support arrangement according to an alternative mode of the above preferred embodiment of the present invention.
Figure 8:
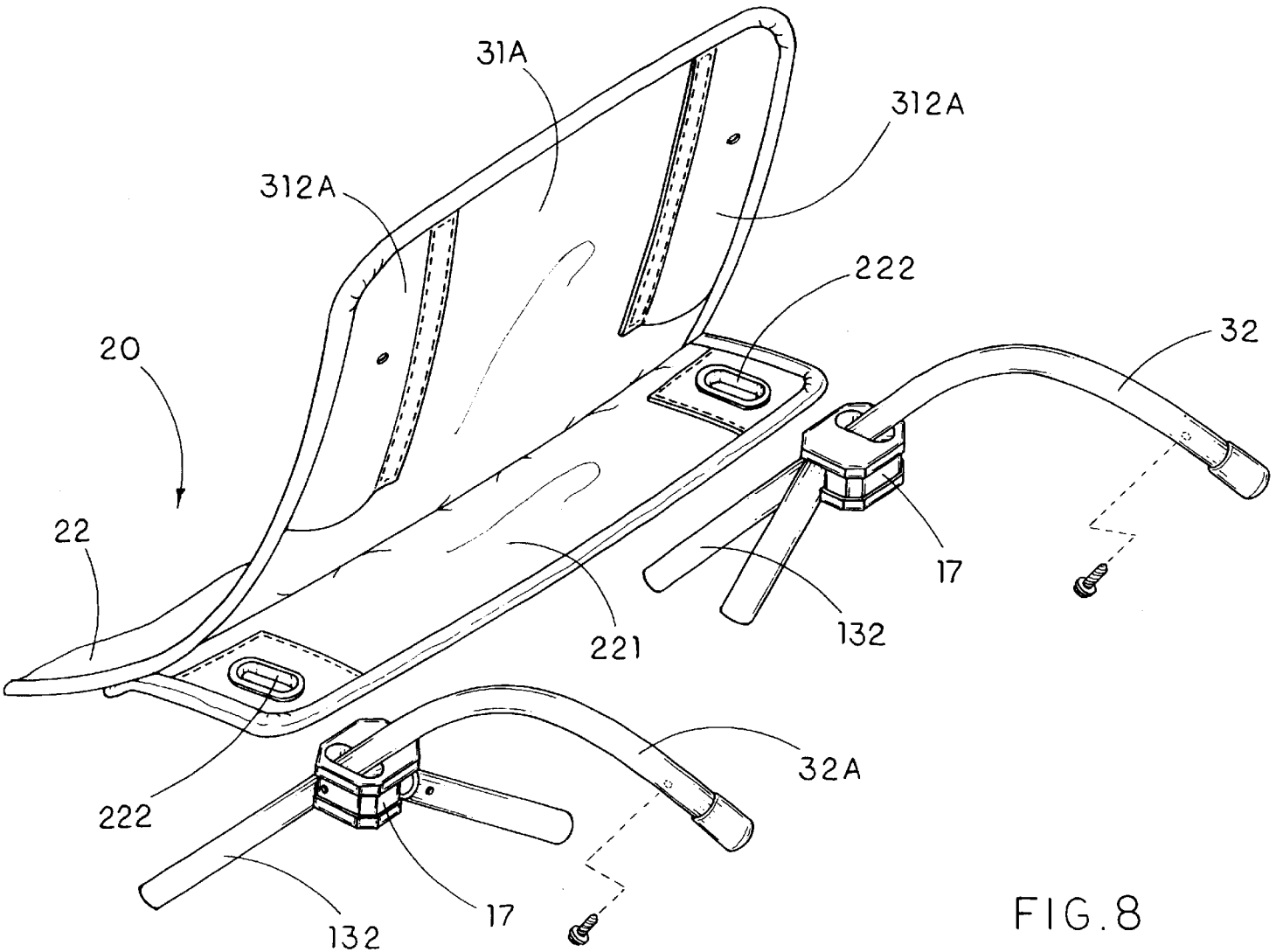
FIG. 8 is a partial exploded perspective of the seat support arrangement of the folding chair according to the above alternative mode of the above preferred embodiment of the present invention.
Figure 9:
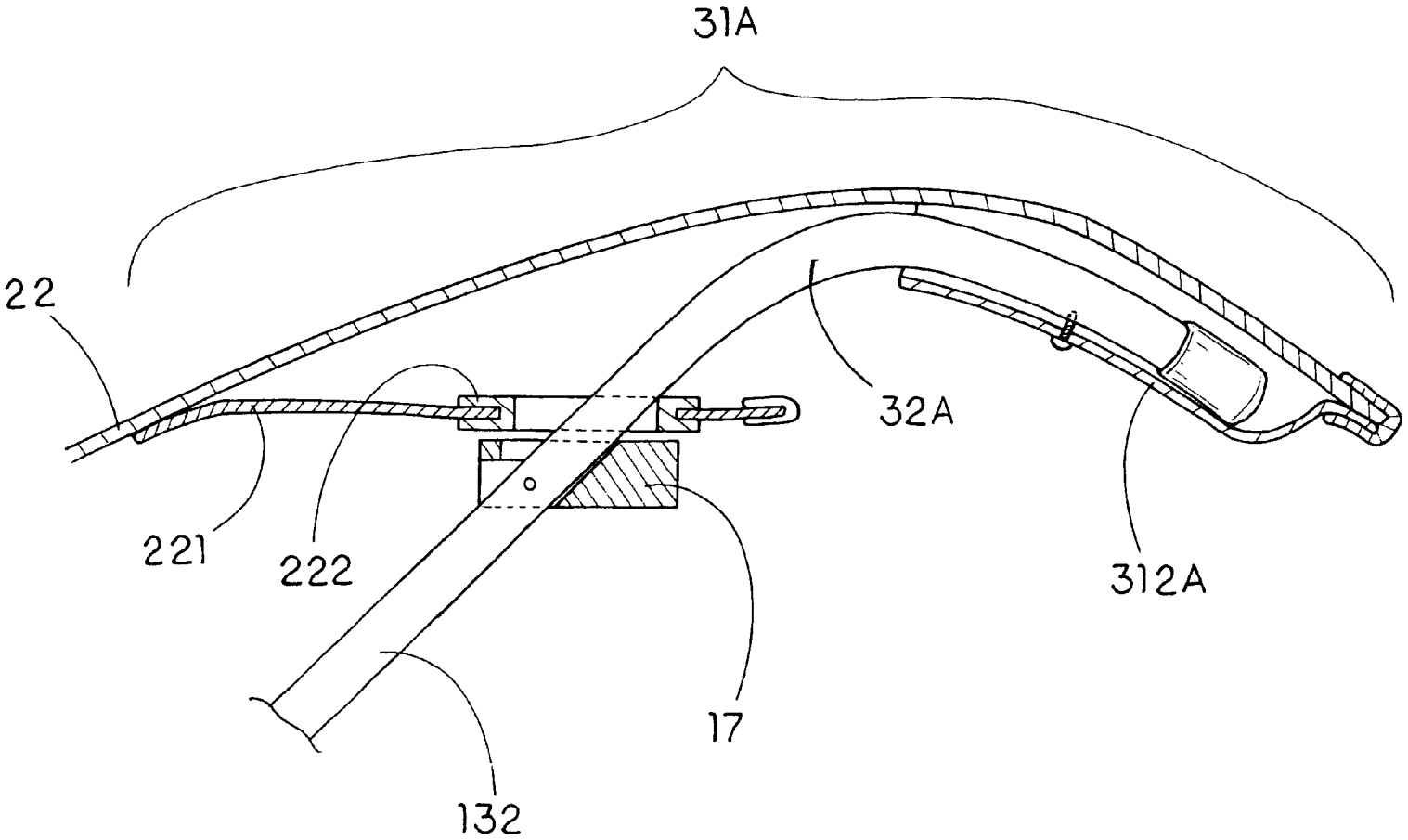
FIG. 9 is a sectional side view of the seat support arrangement of the folding chair according to the above alternative mode of the above preferred embodiment of the present invention.

Referring to FIGS. 7 to 9, an alternative mode of the seat support arrangement of the above preferred embodiment of the present invention is illustrated, wherein the two seat supporting arms 32*a* of the alternative mode are further frontwardly extended to form two elongated and curved arms. The width of the thigh supporting flap 31*a* of this alternative mode is also increased to match the elongated length of the pair of seat supporting arms 32*a*, wherein two longer side pockets 312*a* are also provided at two side edges of a bottom surface of the thigh supporting flap 31*a* to receive the end portion of the pair of seat supporting arms 32*a*, as shown in FIG. 9, so as to mount and hold the thigh supporting flap 31*a* in position.

As shown in FIGS. 7 and 9, the thigh supporting area of the thigh supporting flap 31*a* is increased and the curved seat supporting arms 32*a* also support the curved shape of the thigh supporting flap 31*a* to better and more comfortably support the thighs and shins of the user's legs.

However, in order to also better support the seat support portion 22 of the fabric seat 20, a reinforce flap 221 is connected to a bottom surface of the seat support portion 22 and frontwardly extended underneath the seat support portion 22 toward the two front upper frame joints 17. Two front comers of the reinforce flap 221 provided with two leg placement rings 222 respectively for the two second side frame leg 132 to penetrate therethrough respectively so as to enable the two leg placement rings 222 and the reinforce flap 221 resting on the two front upper frame joints 17 for additionally supporting the seat support portion 22 of the fabric seat 20 and distributing the downward pulling force applied by the user's weight on the fabric seat 20.

Since the second side frame legs 132 are inclinedly penetrating through the two front upper frame joints 17 respectively, the leg placement rings 222 are preferred to be made in oval shape to fit the cross sectional shape of the inclined second side frame legs 132.

Figure 1:
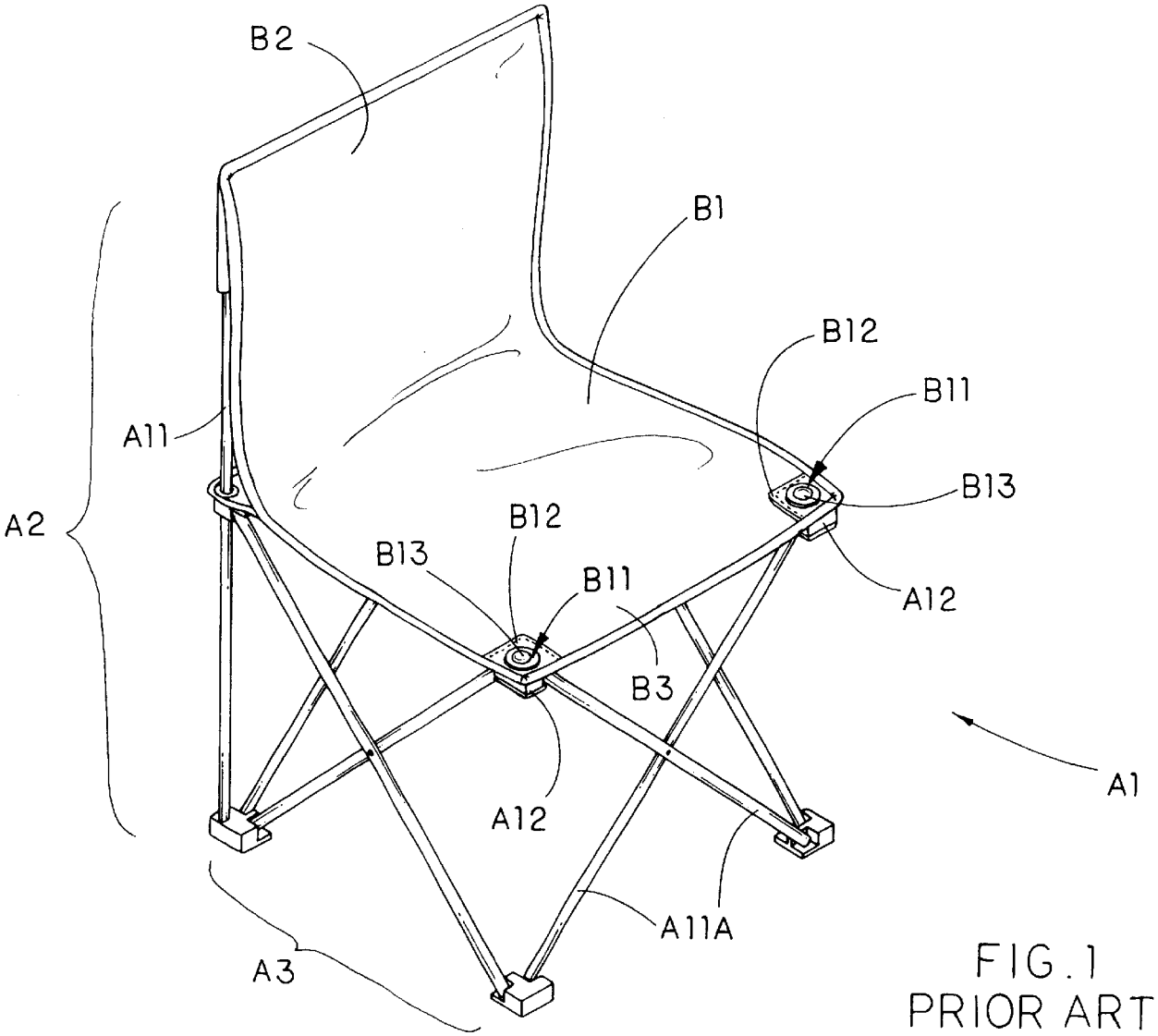
FIG. 1 PRIOR ART
FIG. 1 is a perspective view of a conventional folding chair.

According to the preferred embodiment and alternative mode of the present invention disclosed above, when a user sits on the folding chair 1, the user's weight applies downward pulling force will be more evenly distributed through the enlarged sitting area. More thigh can be supported by the enlarged seat support portion 22, i.e. the thigh supporting flap 32 or 32*a*. Due to the supporting area between the fabric seat 20 and the foldable chair frame 10 is largely increased to the two side edges of the seat supporting flap 32 or 32*a* in stead of the side edge of the leg placement holes of the conventional folding chair as shown in FIG. 1, so that the folding chair 1 of the present invention is more durable and comfortable.

What is claimed is:

1. A seat support arrangement for a folding chair which comprises a foldable chair frame supporting a fabric seat having a back support portion and a seat support portion, wherein said seat support arrangement comprises a thigh supporting flay integrally and frontwardly extended from a front end of said seat support portion of said fabric seat, and a pair of seat supporting arms which are frontwardly extended from two front upper frame joints of said foldable chair frame and Parallelly connected to two side edges of said thigh supporting flap so as to evenly support said seat support portion in such a manner that said thigh supporting flap of said fabric seat is firmly supported to extend frontwardly so as to substantially increase a seat area of said seat support portion of said fabric seat, wherein said foldable chair frame comprises a pair of back frame legs, a pair of front frame legs pivotally connected in cross manner, and two pairs of side frame legs, wherein each pair of said side frame legs includes a first side frame leg and a second side frame leg pivotally connected in cross manner, wherein two upper ends of said twoside frame legs are pivotally connected to said two front upper frame joints respectively.

2. The seat supporting arrangement, as recited in claim 1, wherein said pair seat supporting arms are two upper end portions of said two second side frame legs respectively.

3. The seat supporting arrangement, as recited in claim 2, wherein said pair of seat supporting arms are extended through said two front upper frame joints respectively and bent downwardly.

4. The seat supporting arrangement, as recited in claim 3, wherein each of said front upper frame joints has a support slot provided therethrough for said respective second side frame leg to penetrate therethrough upwardly and frontwardly to form said seat supporting arm.

5. The seat supporting arrangement, as recited in claim 4, wherein an inclined resting surface is provided within said support slot in order to fittingly support said respectively inclined second side frame leg which is pivotally connected to said front upper frame joint.

6. The seat supporting arrangement, as recited in claim 5, wherein said thigh supporting flap have two side pockets provided at two side edges of a bottom surface thereof to receive said two seat supporting arms therein respectively so as to firmly hold said seat support portion and said thigh supporting flap of said fabric seat to said two seat supporting arms.

7. The seat supporting arrangement, as recited in claim 6, wherein each of said side pockets has a front close end and a rear open end to define a tubular pocket cavity therein, and each of said pocket cavities has a depth shorter than said seat supporting arm, wherein two screws are used to fasten said two side pockets to said two seat supporting arms respectively.

8. The seat supporting arrangement, as recited in claim 4, wherein said support slot of said front upper frame joint comprises a side groove that provides an inclined resting surface to support said inclined second side frame leg which is pivotally connected to a side wall of said support slot.

9. The seat supporting arrangement, as recited in claim 4, wherein said thigh supporting flap have two side pockets provided at two side edges of a bottom surface thereof to receive said two seat supporting arms therein respectively so as to firmly hold said seat support portion and said thigh supporting flap of said fabric seat to said two seat supporting arms.

10. The seat supporting arrangement, as recited in claim 9, wherein each of said side pockets has a front close end and a rear open end to define a tubular pocket cavity therein, and each of said pocket cavities has a depth shorter than said seat supporting arm, wherein two screws are used to fasten said two side pockets to said two seat supporting arms respectively.

11. The seat supporting arrangement, as recited in claim 3, wherein said thigh supporting flap has a cushion pad enclosed therein.

12. The seat supporting arrangement, as recited in claim 2, wherein said two seat supporting arms are frontwardly extended through said two front upper frame joints respectively and bent to form two elongated and curved arms.

13. The seat supporting arrangement, as recited in claim 12, wherein each of said front upper frame joints has a support slot provided therethrough for said respective second side frame leg to penetrate therethrough upwardly and frontwardly to form said seat supporting arm.

14. The seat supporting arrangement, as recited in claim 13, wherein an inclined resting surface is provided within said support slot in order to fittingly support said respectively inclined second side frame leg which is pivotally connected to said front upper frame joint.

15. The seat supporting arrangement, as recited in claim 14, wherein said thigh supporting flap have two side pockets provided at two side edges of a bottom surface thereof to receive said two seat supporting arms therein respectively so as to firmly hold said seat support portion and said thigh supporting flap of said fabric seat to said two seat supporting arms.

16. The seat supporting arrangement, as recited in claim 15, wherein each of said side pockets has a front close end and a rear open end to define a tubular pocket cavity therein, and each of said pocket cavities has a depth shorter than said seat supporting arm, wherein two screws are used to fasten said two side pockets to said two a seat supporting arms respectively.

17. The seat supporting arrangement, as recited in claim 16, wherein said seat support portion of said fabric seat further comprises a reinforce flap connected thereto, which is frontwardly extended underneath said seat support portion toward said two front upper frame joints, wherein two front corners of said reinforce flap provided with two leg placement rings respectively for said two second side frame leg to penetrate therethrough respectively so as to enable said two leg placement rings and said reinforce flap resting on said two front upper frame joints.

18. The seat supporting arrangement, as recited in claim 17, wherein each of said leg placement rings has an oval shape to fit a cross sectional shape of each of said inclined second side frame legs.

19. The seat supporting arrangement, as recited in claim 15, wherein said seat support portion of said fabric seat further comprises a reinforce flap connected thereto, which is frontwardly extended underneath said seat support portion toward said two front upper frame joints, wherein two front corners of said reinforce flap provided with two leg placement rings respectively for said two second side frame leg to penetrate therethrough respectively so as to enable said two leg placement rings and said reinforce flap resting on said two front upper frame joints.

20. The seat supporting arrangement, as recited in claim 14, wherein said seat support portion of said fabric seat further comprises a reinforce flap connected thereto, which is frontwardly extended underneath said seat support portion toward said two front upper frame joints, wherein two front corners of said reinforce flap provided with two leg placement rings respectively for said two second side frame leg to penetrate therethrough respectively so as to enable said two leg placement rings and said reinforce flap resting on said two front upper frame joints.

21. The seat supporting arrangement, as recited in claim 13, wherein said support slot of said front upper frame joint comprises a side groove that provides an inclined resting surface to support said inclined second side frame leg which is pivotally connected to a side wall of said support slot.

22. The seat supporting arrangement, as recited in claim 21, wherein said seat support portion of said fabric seat further comprises a reinforce flap connected thereto, which is frontwardly extended underneath said seat support portion toward said two front upper frame joints, wherein two front corners of said reinforce flap provided with two leg placement rings respectively for said two second side frame leg to penetrate therethrough respectively so as to enable said two leg placement rings and said reinforce flap resting on said two front upper frame joints.

23. The seat supporting arrangement, as recited in claim 13, wherein said thigh supporting flap have two side pockets provided at two side edges of a bottom surface thereof to receive said two seat supporting arms therein respectively so as to firmly hold said seat support portion and said thigh supporting flap of said fabric seat to said two seat supporting arms.

24. The seat supporting arrangement, as recited in claim 23, wherein each of said side pockets has a front close end and a rear open end to define a tubular pocket cavity therein, and each of said pocket cavities has a depth shorter than said seat supporting arm, wherein two screws are used to fasten said two side pockets to said two seat supporting arms respectively.

25. The seat supporting arrangement, as recited in claim 24, wherein said seat support portion of said fabric seat further comprises a reinforce flap connected thereto, which is frontwardly extended underneath said seat support portion toward said two front upper frame joints, wherein two front corners of said reinforce flap provided with two leg placement rings respectively for said two second side frame leg to penetrate therethrough respectively so as to enable said two leg placement rings and said reinforce flap resting on said two front upper frame joints.

26. The seat supporting arrangement, as recited in claim 23, wherein said seat support portion of said fabric seat further comprises a reinforce flap connected thereto, which is frontwardly extended underneath said seat support portion toward said two front upper frame joints, wherein two front corners of said reinforce flap provided with two leg placement rings respectively for said two second side frame leg to penetrate therethrough respectively so as to enable said two leg placement rings and said reinforce flap resting on said two front upper frame joints.

27. The seat supporting arrangement, as recited in claim 13, wherein said seat support portion of said fabric seat firther comprises a reinforce flap connected thereto, which is frontwardly extended underneath said seat support portion toward said two front upper frame joints, wherein two front corners of said reinforce flap provided with two leg placement rings respectively for said two second side frame leg to penetrate therethrough respectively so as to enable said two leg placement rings and said reinforce flap resting on said two front upper frame joints.

28. The seat supporting arrangement, as recited in claim 12, wherein said seat support portion of said fabric seat further comprises a reinforce flap connected thereto, which is frontwardly extended underneath said seat support portion toward said two front upper frame joints, wherein two front corners of said reinforce flap provided with two leg placement rings respectively for said two second side frame leg to penetrate therethrough respectively so as to enable said two leg placement rings and said reinforce flap resting on said two front upper frame joints.

29. The seat supporting arrangement, as recited in claim 28, wherein each of said leg placement rings has an oval shape to fit a cross sectional shape of each of said inclined second side frame legs.

30. The seat supporting arrangement, as recited in claim 12, wherein said thigh supporting flap has a cushion pad enclosed therein.

31. The seat supporting arrangement, as recited in claims 2, wherein said thigh supporting flap has a cushion pad enclosed therein.

32. The seat supporting arrangement, as recited in claim 1, wherein said thigh supporting flap have two side pockets provided at two side edges of a bottom surface thereof to receive said two seat supporting arms therein respectively so as to firmly hold said seat support portion and said thigh supporting flap of said fabric seat to said two seat supporting arms.

33. The seat supporting arrangement, as recited in claim 32, wherein each of said side pockets has a front close end and a rear open end to define a tubular pocket cavity therein, and each of, said pocket cavities has a depth shorter than said seat supporting arm, wherein two screws are used to fasten said two side pockets to said two seat supporting arms respectively.

34. The seat supporting arrangement, as recited in claim 1, wherein said thigh supporting flap has a cushion pad enclosed therein.

* * * * *